US008776409B2

(12) United States Patent
Noto

(10) Patent No.: US 8,776,409 B2
(45) Date of Patent: Jul. 15, 2014

(54) APPARATUS FOR REMOVING WRINKLES FROM FABRIC

(75) Inventor: Anthony Peter Noto, Knightdale, NC (US)

(73) Assignee: Notable Creations, Inc., Knightdale, NC (US)

( * ) Notice: Subject to any disclaimer, the term of this patent is extended or adjusted under 35 U.S.C. 154(b) by 49 days.

(21) Appl. No.: 13/452,757

(22) Filed: Apr. 20, 2012

(65) Prior Publication Data

US 2012/0266502 A1 Oct. 25, 2012

Related U.S. Application Data

(60) Provisional application No. 61/477,586, filed on Apr. 20, 2011.

(51) Int. Cl.

| | |
|---|---|
| ***D06F 75/18*** | (2006.01) |
| ***D06F 71/34*** | (2006.01) |
| ***D06F 71/00*** | (2006.01) |
| *D06F 75/38* | (2006.01) |

(52) U.S. Cl.
CPC ..... *D06F 71/00* (2013.01); *D06F 71/34* (2013.01)
USPC ..... 38/77.3; 38/77.8; 38/93

(58) Field of Classification Search
CPC ..... D06F 75/00; D06F 75/08; D06F 75/14; D06F 75/18; D06F 75/20; D06F 75/38
USPC ..... 38/77.83, 80, 81, 93; 239/102.2
See application file for complete search history.

(56) References Cited

U.S. PATENT DOCUMENTS

| | | | | |
|---|---|---|---|---|
| 819,761 | A | 5/1906 | Johnson | |
| 2,362,591 | A | 11/1944 | Smith | |
| 2,817,169 | A | 12/1957 | Schott | |
| 3,045,371 | A * | 7/1962 | Kurlinski | 38/77.9 |
| 3,273,267 | A | 9/1966 | Willman | |
| 3,811,208 | A | 5/1974 | Vieceli et al. | |
| 3,906,187 | A | 9/1975 | Turoczi, Jr. | |

(Continued)

FOREIGN PATENT DOCUMENTS

| | | | |
|---|---|---|---|
| CN | 202170442 | U | 3/2012 |
| DE | 214404 | A1 | 10/1984 |

(Continued)

OTHER PUBLICATIONS

International Search Report and Written Opinion dated Nov. 16, 2012, for corresponding PCT/US12/34577 filed Apr. 20, 2012; references included herein.

(Continued)

*Primary Examiner* — Ismael Izaguirre
(74) *Attorney, Agent, or Firm* — Nifong, Kiefer and Klinck, PLLC

(57) ABSTRACT

A wrinkle removing apparatus for fabric articles is provided. The apparatus includes a casing defining a volume therein and a reservoir received in the casing and containing a liquid for providing treatment to the fabric article. A platen is carried by the casing and defines a plurality of openings for allowing flow-through of liquid. A heater may be proximal the platen for heating the platen to a treatment temperature. A transducer extends into the reservoir and is configured for atomizing the liquid into a vapor.

25 Claims, 7 Drawing Sheets

(56) References Cited

U.S. PATENT DOCUMENTS

| | | | | | |
|---|---|---|---|---|---|
| 4,063,376 | A | | 12/1977 | Horiuchi | |
| 4,233,763 | A | | 11/1980 | McMullen | |
| 4,459,771 | A | | 7/1984 | Ogata | |
| 4,545,561 | A | * | 10/1985 | Brown | 251/129.08 |
| 4,571,483 | A | | 2/1986 | Fathi | |
| 4,646,451 | A | | 3/1987 | Nakao et al. | |
| 4,656,763 | A | * | 4/1987 | Kawasaki et al. | 38/77.83 |
| 4,817,309 | A | | 4/1989 | Frank et al. | |
| 4,857,703 | A | * | 8/1989 | Wilkins | 392/399 |
| D312,905 | S | * | 12/1990 | Davidson et al. | D32/71 |
| 5,094,021 | A | | 3/1992 | Chen | |
| 5,642,579 | A | | 7/1997 | Netten et al. | |
| 5,751,074 | A | | 5/1998 | Prior et al. | |
| 5,787,537 | A | | 8/1998 | Mannillo | |
| 5,787,614 | A | * | 8/1998 | Stutzer | 38/77.1 |
| 5,799,422 | A | * | 9/1998 | Demuth et al. | 38/93 |
| 5,852,279 | A | | 12/1998 | Mak et al. | |
| 6,035,563 | A | | 3/2000 | Hoefer et al. | |
| 6,216,369 | B1 | * | 4/2001 | Wolf et al. | 38/93 |
| 6,785,989 | B2 | | 9/2004 | Rienzo et al. | |
| 6,802,141 | B2 | | 10/2004 | Walther | |
| 6,986,217 | B2 | | 1/2006 | Leung et al. | |
| 7,062,869 | B1 | | 6/2006 | Pilcher et al. | |
| 7,121,024 | B1 | | 10/2006 | Clevenberg | |
| 7,124,523 | B2 | | 10/2006 | Asvadi et al. | |
| 7,305,780 | B2 | | 12/2007 | Lukas et al. | |
| 7,389,597 | B1 | | 6/2008 | Chen | |
| 7,546,701 | B2 | | 6/2009 | Alipour | |
| 7,661,212 | B2 | | 2/2010 | Hahn | |
| 2003/0121900 | A1 | | 7/2003 | Wang | |
| 2004/0026398 | A1 | | 2/2004 | Wehrwein et al. | |
| 2004/0084433 | A1 | | 5/2004 | Field et al. | |
| 2004/0096369 | A1 | * | 5/2004 | Daoting | 422/124 |
| 2008/0209773 | A1 | | 9/2008 | Akhter | |
| 2010/0107457 | A1 | | 5/2010 | Balaji et al. | |
| 2010/0146826 | A1 | | 6/2010 | Lee et al. | |
| 2010/0199528 | A1 | | 8/2010 | Fabrikant | |
| 2011/0107626 | A1 | * | 5/2011 | Mandica et al. | 38/77.6 |
| 2012/0023789 | A1 | | 2/2012 | Harrington | |

FOREIGN PATENT DOCUMENTS

| | | | | |
|---|---|---|---|---|
| DE | 19735214 | A1 | | 2/1998 |
| EP | 1300502 | A1 | | 4/2003 |
| GB | 831574 | A | | 3/1960 |
| JP | 402243199 | A | * | 9/1990 |
| JP | 2574446 | B | | 10/1996 |
| NL | 8500292 | A | | 2/1986 |

OTHER PUBLICATIONS

Office Action and translation for corresponding Chinese application, issued Feb. 18, 2014.

* cited by examiner

APPARATUS FOR REMOVING WRINKLES FROM FABRIC

CROSS-REFERENCE TO RELATED APPLICATIONS

This application claims priority to U.S. Provisional Application No. 61/477,586 filed on Apr. 20, 2011, the entire contents of which are herein incorporation by reference.

TECHNICAL FIELD

This disclosure is related to an apparatus for removing wrinkles from fabric, and more particularly towards an apparatus configured for applying one of a heat and a water treatment to a fabric for removing wrinkles thereof.

BACKGROUND

Irons are used for removing wrinkles in fabrics such as clothing articles. Specifically, irons are used for straightening fabric fibers by the use of heat and, sometimes, moisture treatment to the fabric. These irons typically include a flat surface configured for being pressed against the surface of the fabric. The flat surface is heated to a desired treatment temperature for a given fabric or clothing article.

One disadvantage of conventional irons is that conventional irons rely on high temperatures to overcome the glass transition temperature of fabrics in order to release the wrinkles. In cases where water is used to wet the fabrics and lower the glass transition temperature, high temperatures are required to dry the fabrics after wetting them. Steam irons typically rely upon the heat generated by the flat surface to convert treatment liquids into a mist for treating the fabric or article of clothing therewith. These techniques require a certain, relatively high temperature of the flat surface which causes various safety concerns due to the temperature of the pressing surface. These product designs are not intended for use on the person while wearing the garment to be de-wrinkled. These product designs carry risk not only for burning individuals and garments but also for potentially starting fires. Other methods and products developed for clothing wrinkle removers include spray solutions for application to the clothing article and steaming chambers for applying steam to the article. Handheld steamers also carry the risk of burning an individual and as a consequence are not intended for use on the person wearing the garment. The wrinkle releaser spray solution's drawback is that the solution significantly wets the garments and must be dried before use and risk re-introduction of wrinkles. Both the steamers and the sprays are also not as effective as an iron with a soleplate to smooth the fabric.

Accordingly, a clothing wrinkle remover that addresses the various problems associated with conventional irons is needed. The one or more embodiments disclosed herein remove wrinkles from fabrics without the use of high temperatures thus eliminating the risk of burns or fires. By simply humidifying the fabric with a room temperature fine particle mist, the glass transition temperature of the garment is lowered which allows for a safe touch temperature soleplate to be used. This permits the device to be used on the person while wearing the garment. To achieve the above requires a delicate balance of design features and parameters.

SUMMARY

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter.

Disclosed herein is a wrinkle removing apparatus for fabric articles. The apparatus includes a casing defining a volume therein and a reservoir configured for being selectively received in the casing and containing a liquid for providing treatment to the fabric article. A platen is carried by the casing and defines a plurality of openings for allowing flowthrough of liquid.

According to one or more embodiments, the apparatus further includes a transducer configured for being received in the liquid reservoir when the liquid reservoir is received in the casing. The transducer is configured for atomizing the liquid.

According to one or more embodiments, the transducer is a vibratory transducer configured to convert liquid in the reservoir into a mist.

According to one or more embodiments, the casing defines a pathway between the reservoir and the openings of the platen.

According to one or more embodiments, the apparatus includes one of a fan and a blower in communication with the pathway for creating a pressure differential to aid flow of liquid from the reservoir to the openings of the platen.

According to one or more embodiments, the apparatus includes a valve in the pathway for restricting flowthrough of liquid.

According to one or more embodiments, the apparatus includes a button on the casing in communication with the valve for selectively moving the valve between a closed position and an open position.

According to one or more embodiments, the button communicates with one of the transducer or an electronics activating switch.

According to one or more embodiments, the valve is biased into a closed position.

According to one or more embodiments, the apparatus includes a perturbator positioned proximal the platen.

According to one or more embodiments, the platen defines a plurality of grooves, a portion of which define the plurality of openings.

According to one or more embodiments, the grooves define generally a cross-section such that the depth of the grooves at a medial position thereof is greater than the depth at an end position thereof such that the liquid tends to be maintained in a medial portion of the grooves.

According to one or more embodiments, the apparatus includes a vapor guide defined in the pathway. The vapor guide defines an opening for allowing flowthrough of mist.

According to one or more embodiments, the apparatus includes a heating element.

According to one or more embodiments, the heating element is positioned proximal the platen.

According to one or more embodiments, the heating element is positioned within the platen.

According to one or more embodiments, the apparatus includes liquid level sensors configured for extending into the reservoir to determine a liquid level therein.

According to one or more embodiments, the sensors are in communication with a computer module, the module being in communication with the atomizing transducer and configured for controlling operation of the transducer depending on the liquid level of the reservoir.

According to one or more embodiments, a wrinkle removing apparatus for fabric articles is provided. The apparatus includes a casing defining a volume therein and a reservoir received in the casing and containing a liquid for providing treatment to the fabric article. A platen is carried by the casing and defines a plurality of openings for allowing flow-through of liquid. A heater may be proximal the platen for heating the platen or garment to a treatment temperature. A transducer extends into the reservoir and is configured for atomizing the liquid into a vapor.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed. In the drawings.

DETAILED DESCRIPTION

The presently disclosed invention is described with specificity to meet statutory requirements. However, the description itself is not intended to limit the scope of this patent. Rather, the inventors have contemplated that the claimed invention might also be embodied in other ways, to include different steps or elements similar to the ones described in this document, in conjunction with other present or future technologies.

Figure 1:
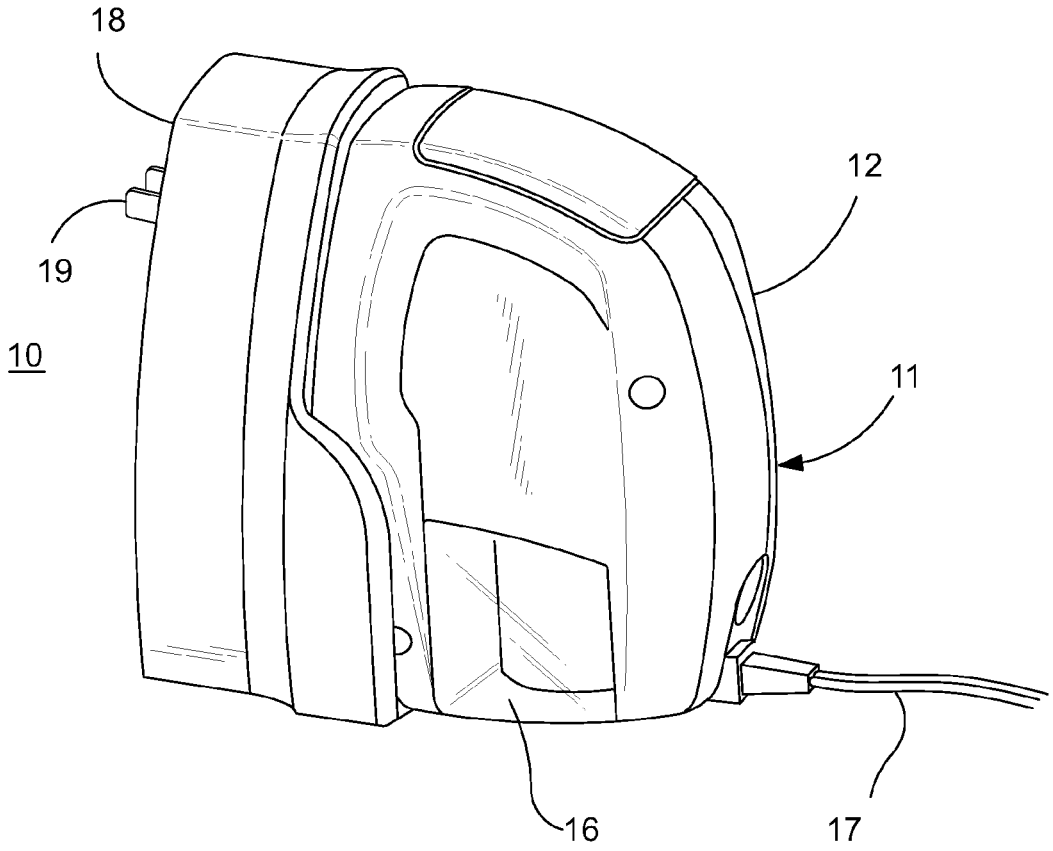
FIG. 1 illustrates a wrinkle remover assembly according to one or more embodiments disclosed herein.
Figure 2:
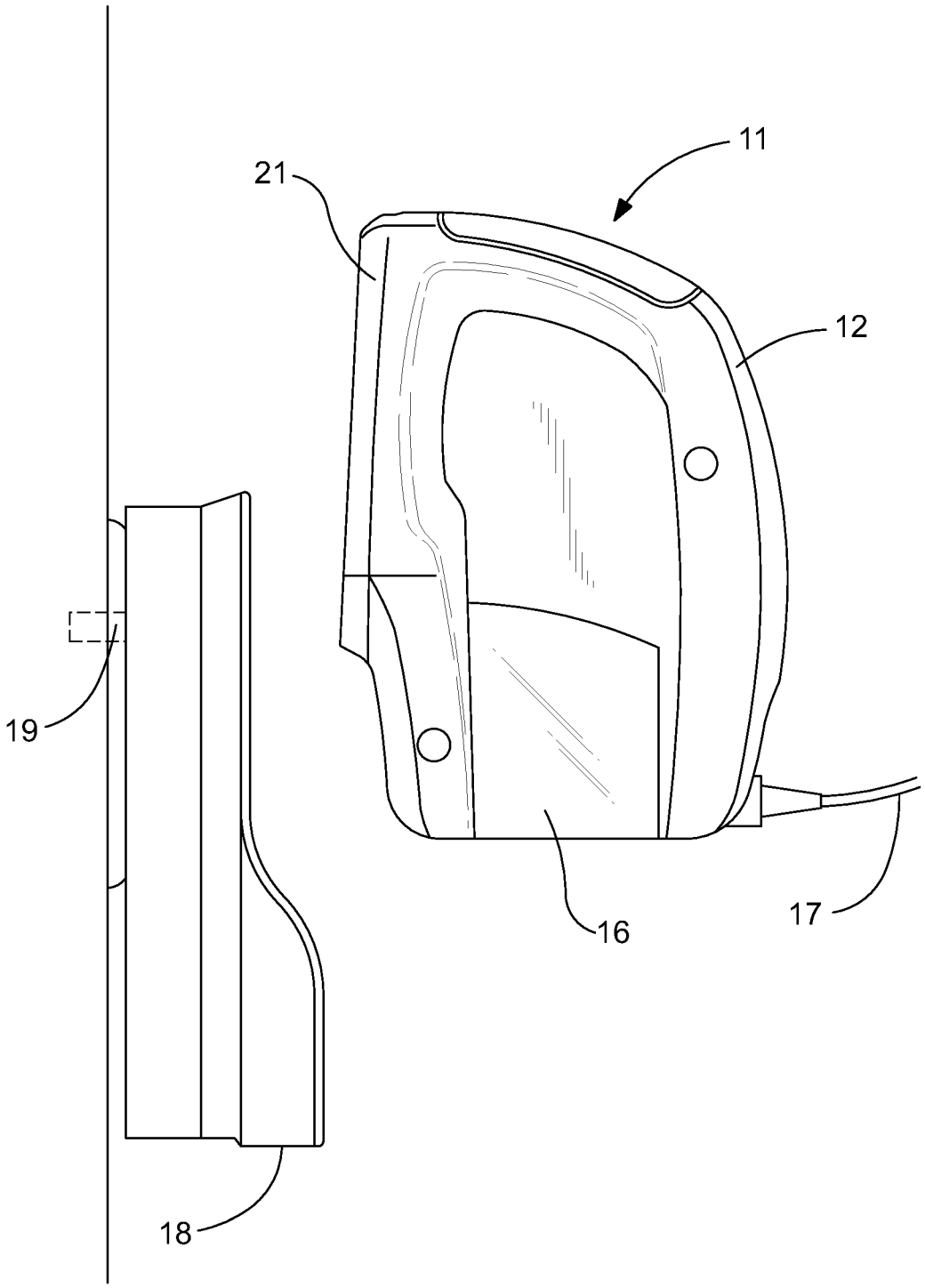
FIG. 2 illustrates a wrinkle remover assembly in which the wrinkle remover apparatus is spaced-apart from a cradle for carrying the apparatus according to one or more embodiments disclosed herein.

FIGS. 1 and 2 illustrate an assembly 10 including a wrinkle removing apparatus 11 and a cradle 18 that carries the apparatus 11. The apparatus 11 is advantageously configured for removing wrinkles from fabric articles such as clothing. The apparatus 11 includes a casing 12 defining a volume 14 therein as illustrated further in FIG. 3. The casing 12 may be made of any appropriately configured material and may take on any appropriately configured shape. A reservoir 16 is configured for being selectively received in the casing 12 and containing a liquid for providing treatment to the fabric article. The reservoir 16 may be selectively received in the casing 12 so that the reservoir 16 can be removed from the casing 12, filled with treatment liquids, and then re-engaged with the casing 12. In this manner, the reservoir 16 can be refilled when empty of treatment liquids. Treatment liquids may include, for example, water, wrinkle releasing formulas, starch-based liquids, or any other desired treatment liquid. In one or more embodiments, the reservoir 16 may include a heating element to heat the treatment liquids to a desired temperature. In one or more embodiments, the desired temperature may be about 40 degrees Celsius. In one or more embodiments, an ultraviolet source may be provided in or proximal the reservoir 16 to sanitize the reservoir 16. In one or more embodiments, the reservoir 16 may further include a fan, blower, or the like for creating positive pressure for driving mist through the apparatus 11.

With further additional reference to the remaining figures, a platen 21 is carried by the casing 12 and is configured for applying heat treatment to the fabric article and the like. The platen 21 may further define a plurality of openings 24 for allowing flowthrough of treatment liquids. The platen 21 may be configured for surface-to-surface engagement with the cradle 18 when the apparatus 11 is installed within the cradle 18 as illustrated in FIG. 1. As illustrated in FIG. 2, the apparatus 11 is removed from the cradle 18 by slidably spacing away the apparatus 11. The platen 21 may have a generally flat surface as illustrated, or may take on any appropriately configured shape such as an arcuate shape. The platen 21 may be made from any appropriately configured material. In one or more embodiments, the platen 21 may be formed from a metal. The platen 21 may be advantageously provided with heating elements described further herein. In one or more embodiments, the platen 21 may be heated to about 50 degrees Celsius. In one or more embodiments, an infrared heating element may be provided proximal the platen 21. The infrared heating element may be an infrared lamp that directs infrared towards the article of clothing to be treated, or, alternatively, an infrared lamp that directs infrared towards the platen 21 to thereby heat the platen.

The cradle 18 may include a connector 19 that may be configured for power communication with a wall outlet as shown. The connector 19 is illustrated as an American-type power connector, but may take on any appropriate configuration. The connector 19 may include a connection with a rechargeable battery source carried by the apparatus 11 so that the apparatus 11 can be used in a portable fashion. In one or more embodiments, the connector 19 is part of a stand-alone power adaptor for the apparatus and this adaptor also acts as a support to maintain the casing 18 proximal a wall or other structure. In one or more embodiments, a power cord 17 may be provided for providing power to the apparatus 11. The cord 17 may be advantageously retractable into the apparatus casing 12 or wrapped around features of the apparatus casing 12 for storage.

Figure 3:
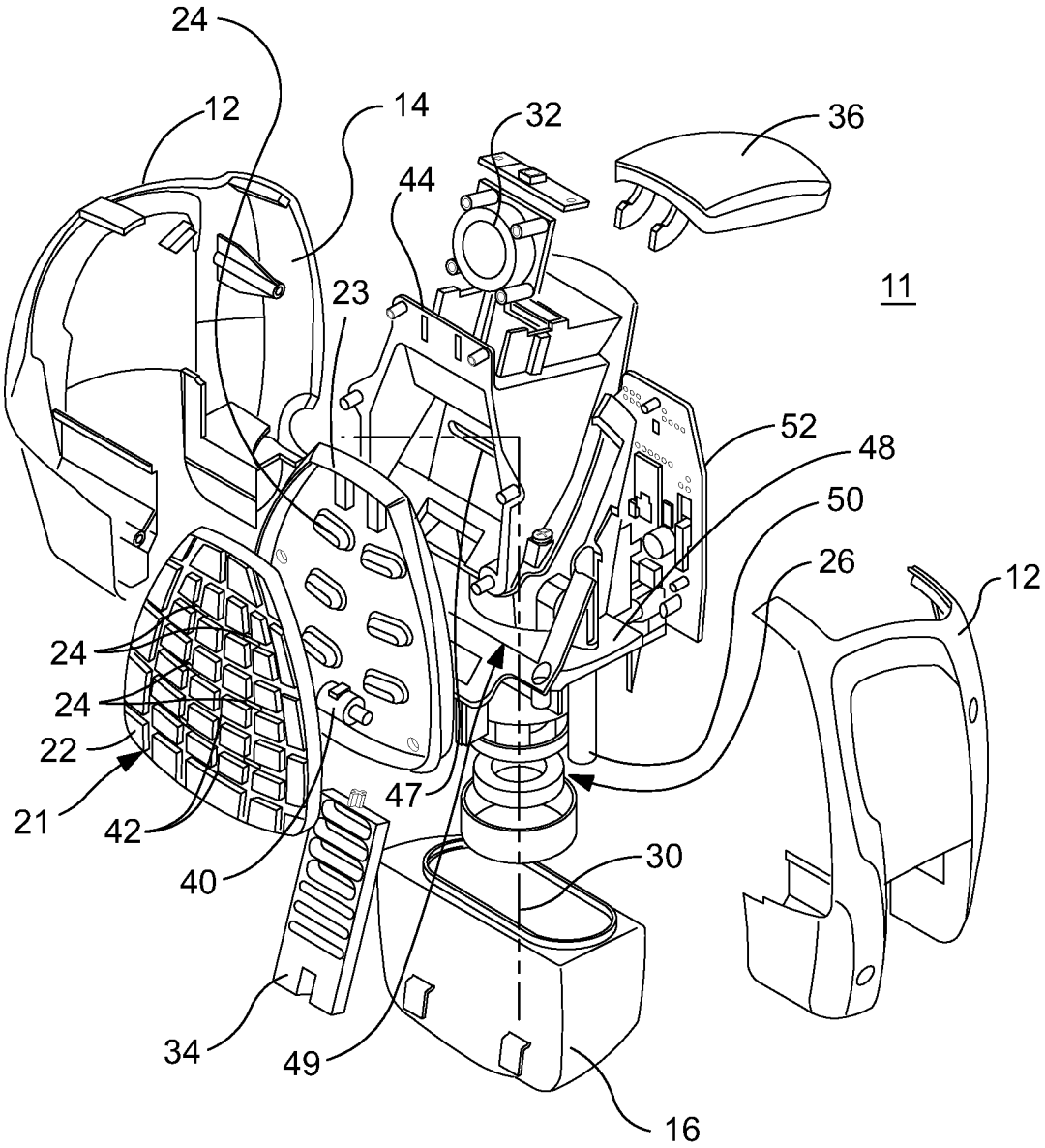
FIG. 3 illustrates an exploded view of the wrinkle remover apparatus according to one or more embodiments disclosed herein.

An exploded view of the apparatus 11 is illustrated in FIG. 3. The apparatus 11 includes a transducer 26 that is configured for being received in the reservoir 16 when the reservoir 16 is received in the casing 12. The transducer 26 is configured for atomizing the treatment liquid. In one or more embodiments, the transducer 26 is a vibratory transducer configured to convert liquid in the reservoir into a mist. The transducer 26 may be, for example, an ultrasonic vibratory transducer. Alternatively, the transducer 26 may be any appropriately configured device that can convert the treatment liquid into a treatment mist, vapor, or gaseous state. The transducer 26 may convert about between 80 and about 90 milliliters per hour.

Figure 4:
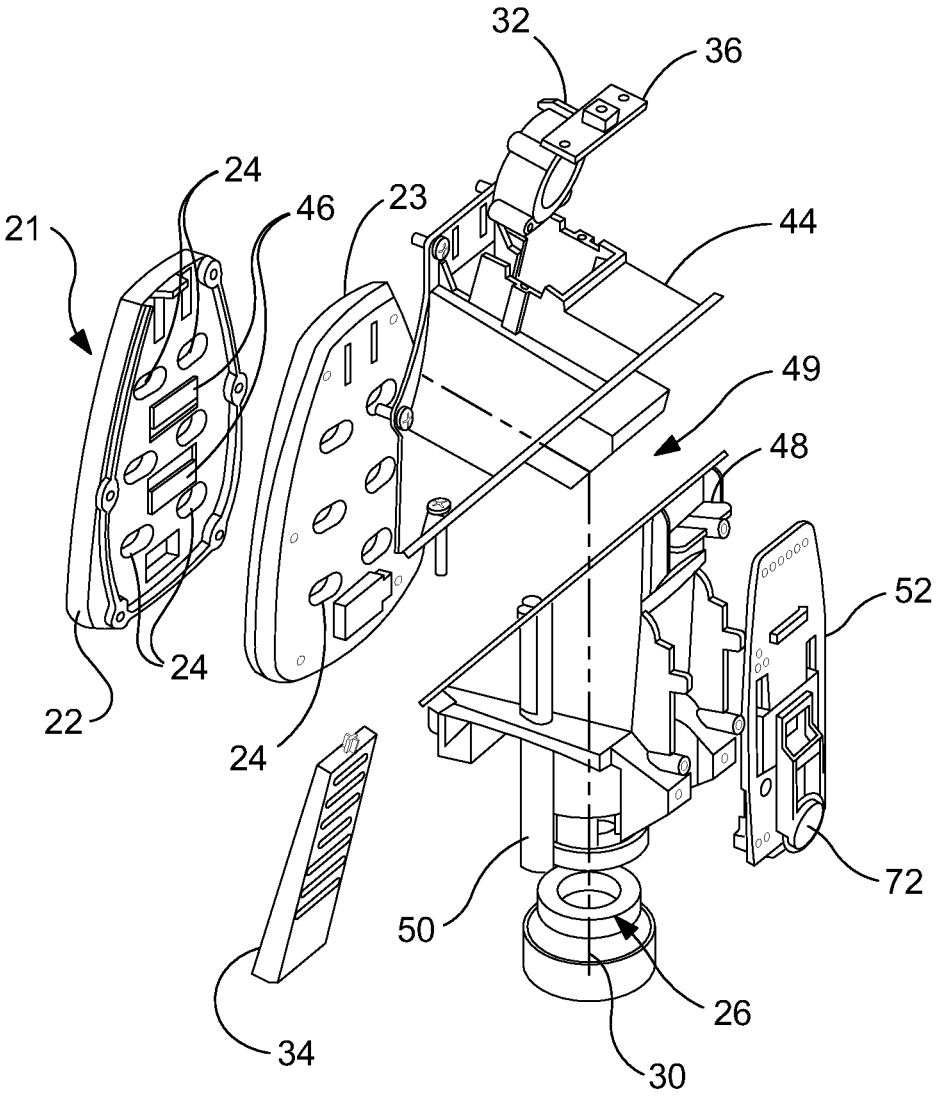
FIG. 4 illustrates an exploded view of a portion of the wrinkle remover apparatus according to one or more embodiments disclosed herein.

The platen 21 may include a first portion 22 and a second portion 23, that cooperatively form a volume therein. A perturbator 40 may be positioned proximal the platen 21, and may further be positioned within the volume defined between the first portion 22 and second portion 23. The perturbator 40 may be for vibrational treatment of the clothing article or the like. As illustrated in FIG. 4, the apparatus 11 may further include a heating element 46 that is carried within the platen 21, and may be carried by the first portion 22. The heating element 46 may be a positive temperature coefficient (PTC) heater. The PTC heater is advantageously selected because of the self-maintaining temperature characteristics associated with PTC heaters such as, for example, a self maintaining temperature of about 60 degrees Celsius. The heating element 46 may have a resistance of about 10 ohms.

Figure 7:
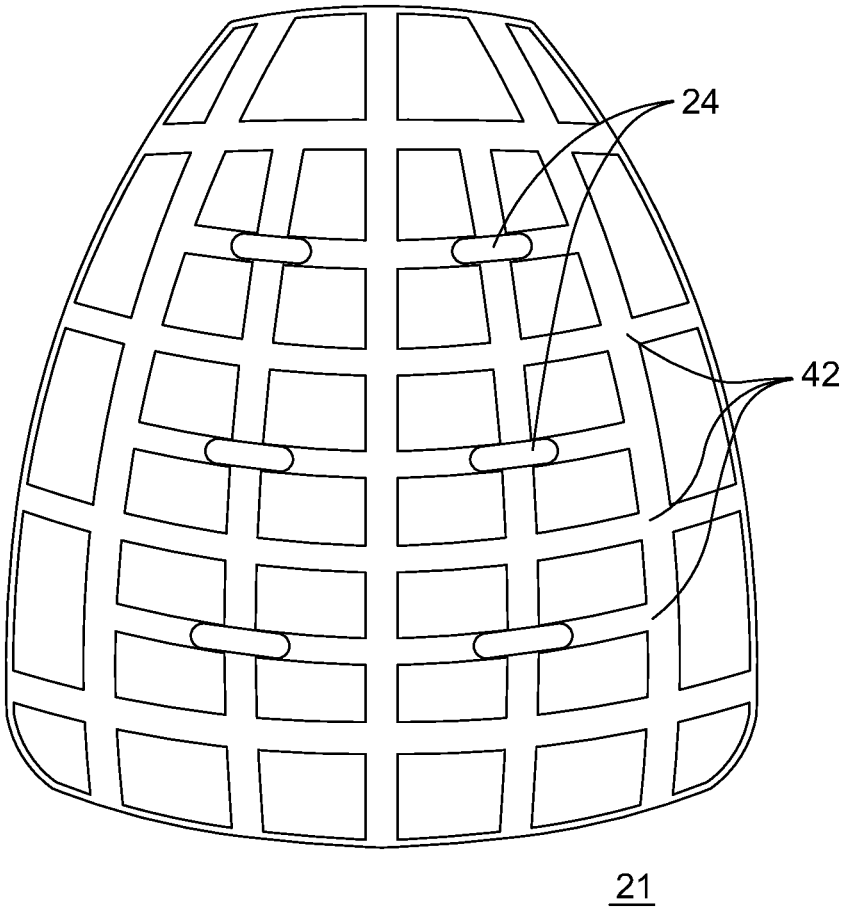
FIG. 7 illustrates a front view of the platen according to one or more embodiments disclosed herein.

With additional reference to FIG. 7, the platen 21 may define a plurality of grooves 42. A portion of the grooves may define the plurality of openings 24. The grooves 42 may define a cross-section such that the depth of the grooves 42 at a medial portion thereof is greater than the depth at an end portion thereof such that the liquid tends to be maintained in a medial portion of the grooves when treatment liquids are being applied. In one or more embodiments, each end portion of the grooves 42 may define a barrier portion such that liquid cannot easily pass through the ends of the grooves 42 when the platen 21 is pressed against an article. The grooves 42 may be formed such that rows of grooves are shown in a generally parallel orientation and transverse grooves run in a generally perpendicular orientation as illustrated. Each adjacent groove 42 may be configured such that a spacing of between about 0.30 inches and about 0.70 inches is maintained. Each groove 42 may have a width of between about 0.08 inches and about 0.15 inches. Each groove 42 may have a depth of between about 0.08 inches and about 0.15 inches, except for the end portions of each groove 42 which may have a depth of about 0.03 inches. The openings 24 may take on any appropriately numbered plurality. In one or more embodiments, there may be between 6 and 21 openings 24 provided. In one or more embodiments, the total area of the openings 24 may be about 0.28 square inches.

The casing 12 defines a pathway 30 indicated by the broken line in FIGS. 3 and 4. The pathway 30 is the pathway in which treatment fluids flow from the reservoir 16 to the openings 24 of the platen 21. In one or more embodiments, a fan 32 may be in communication with the pathway 30 for creating a pressure differential to aid flow of liquid from the reservoir 16 that is converted into mist and to the openings 24 of the platen 21. In one or more embodiments, a blower or other similar structure or device may be employed instead of the fan 32. In one or more embodiments, the fan 32 may be provided to generate a flow rate of between about 0.7 cubic feet per minute (CFM) and 1.5 CFM. In one or more embodiments, the minimum static pressure may be about 0.16 inches of $H_2O$, and the mist conversion rate may be between about 60 milliliters per hour (ml/hr) and about 250 ml/hr.

A valve 34 may be positioned within the pathway 30 for restricting flowthrough of liquid. The valve 34 may include one or more openings for allowing flowthrough of treatment liquid. The apparatus 11 may include a button 36 on the casing 12 in communication with the valve 34 for selectively moving the valve 34 between a closed position and an open position. In one or more embodiments, the valve 34 is biased into a closed position. In one or more embodiments, button 36 or other additional buttons may provide control of one or more features of the apparatus described herein. The button 36 may generally include a trigger portion that is configured for being depressed by the operator and an electrical switching portion that is configured to control one or more operations in response to receiving input from the operator. An on/off button 72 may be provided in an inconspicuous location so that it is not accidentally activated during operation of the apparatus 11. Button 36 or other provided buttons may be configured for controlling the transducer 26 and fan 32.

The apparatus 11 may include a vapor guide 44 defined in the pathway 30 that is configured with mating engagement with portion 23. The vapor guide 44 may define an opening 47 for allowing flowthrough of mist. The valve 34 may be in communication with the vapor guide 44. The vapor guide 44 and chamber 48 form a mist generation chamber 49. The fan 32 may act on the mist generation chamber 49 to drive the mist into the vapor guide 44 and then out platen 21. The mist generating chamber 49 and other internal geometries of the apparatus 11 may be configured such that liquid cannot flow out the openings of the fan port or the vapor guide when the unit is tilted or rotated beyond vertical thus allowing for a variant without a valve while maintaining a spill proof design.

The apparatus 11 may include liquid level sensors 50 that are configured for extending into the reservoir 16 to determine a liquid level therein. The sensors 50 may be in communication with a computer module 52. The module 52 may be in communication with the transducer 26 and configured for controlling operation of the transducer 26 depending on the liquid level of the reservoir 16. For example, if the liquid level is determined to be below a predetermined level, the computer module 52 may turn off power to the transducer and/or one of the more electrical devices disclosed herein. The liquid level sensors 50 may be a capacitance or voltage initiated sensor. The one or more heating elements disclosed herein may be provided with power for a limited period of time, and in one or more embodiments, apparatus 11 may have only a predetermined power supply. Module 52 may contain computer programming code configured for disabling one or more of the devices of the apparatus if the apparatus or certain functions have not been used within a predetermined period of time. In one or more embodiments, the computer module 52 may shutoff the apparatus 11 if the one or more buttons have not been activated in more than about five minutes. In one or more embodiments, the computer module 52 may shutoff the apparatus 11 if the apparatus 11 has been used for more than about 15 minutes. The module 52 may also be configured to cut off power to the transducer 26 if a low liquid level is sensed.

Figure 5:
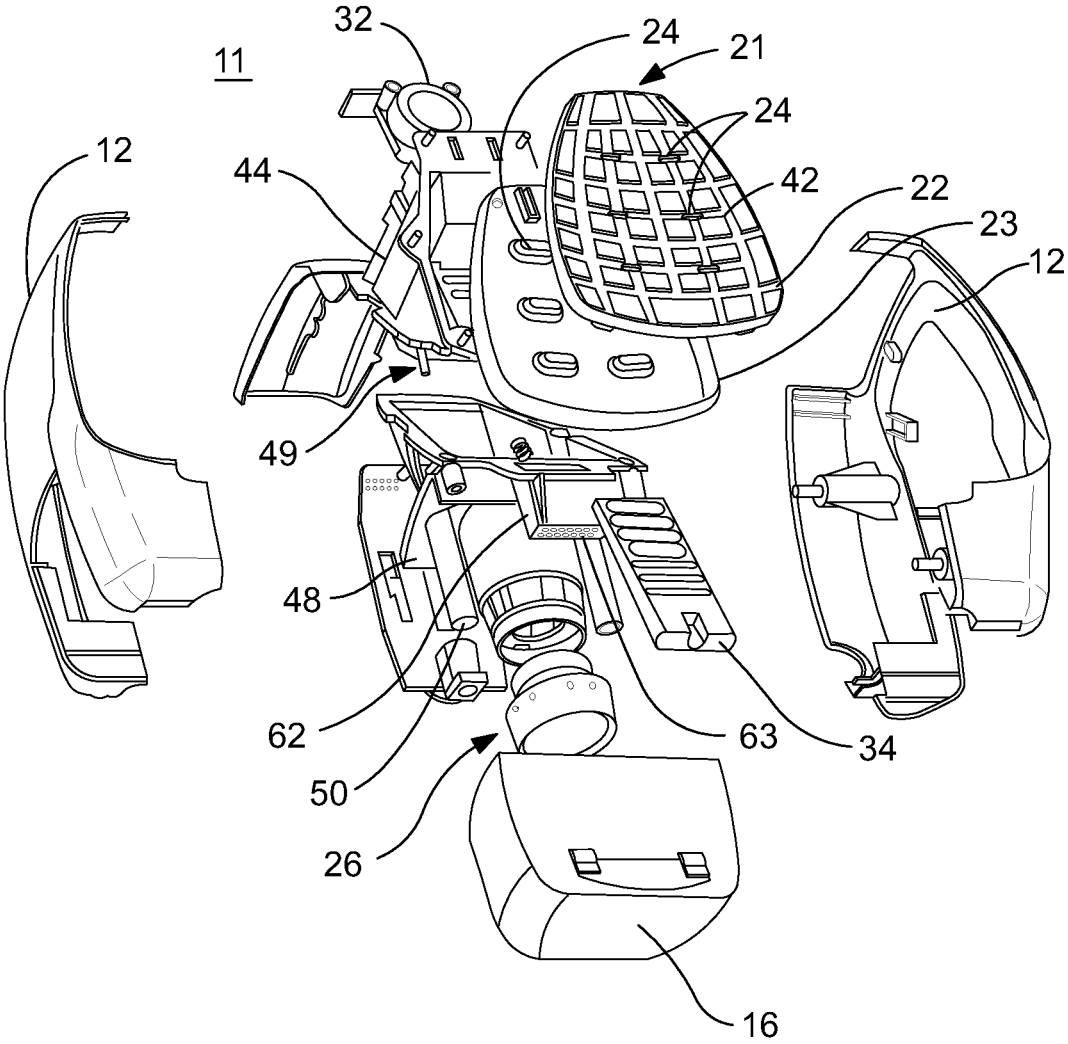
FIG. 5 illustrates an exploded view of a portion of the wrinkle remover apparatus according to one or more embodiments disclosed herein.
Figure 6:
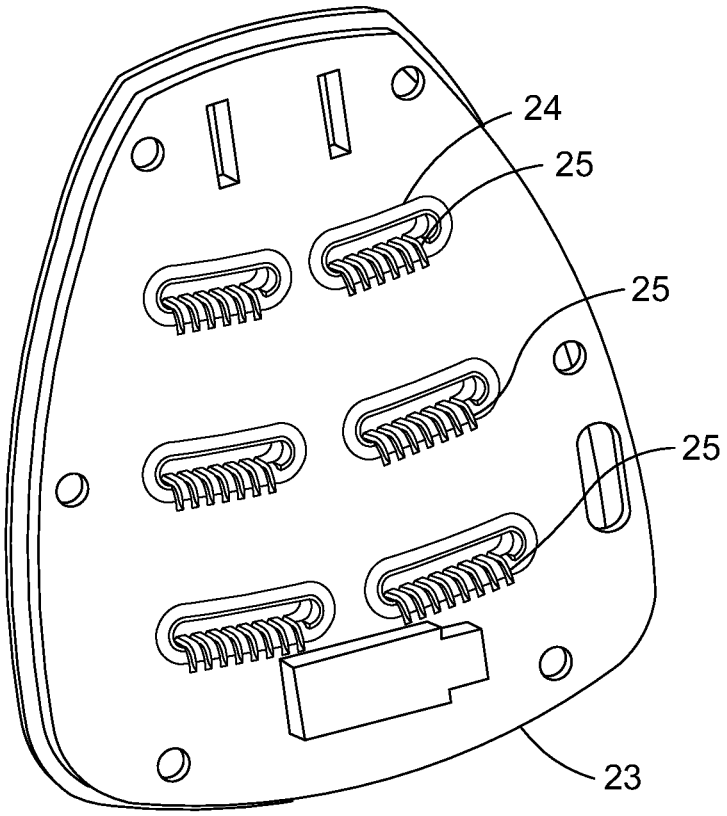
FIG. 6 illustrates a perspective view of a portion of a platen according to one or more embodiments disclosed herein.

In one or more embodiments, a switch 72 may be provided to activate a Light Emitting Diode (LED) indicator light and the one or more heating elements provided herein. In one or more embodiments, a direct current (DC) power jack may be provided. The LED may be any desired color, and, in one or more embodiments, may be a slow blinking blue LED that blinks when the one or more heating elements are in transition to a desired operating temperature. The desired operating temperature may occur at a certain time or may occur when the one or more heating elements or an element of the apparatus 11 reaches a desired temperature. The LED may then illuminate a solid blue light when the apparatus is at temperature. In embodiments in which, perturbator 40 and/or fan 32 are provided, one or both elements may be activated. The LED may be configured to blink at an accelerated rate if the liquid level is too low. As illustrated in FIG. 5, a condensation collector 62 is provided within the apparatus 11. The condensation collector 62 may include a sponge or other liquid absorbing material therein and a plurality of vents 63 that are configured for drying of the absorbing material. To prevent condensation from collecting in the vapor guide 44 and in orifices 24, which could clog orifices or spill out onto fabric, capillary action grooves and other structures will be present to draw the condensation into the collector 62. For example, the second portion 23 of the platen 21 is illustrated more closely in FIG. 6. As illustrated, the second portion 23 defines the openings 24 through which treatment liquids pass through. The openings 24 may further define one or more of capillary grooves 25 that are configured for drawing away condensed treatment liquid so that the condensed liquid does not spill out onto the article to be treated. The capillary grooves 25 are illustrated on only one portion of the perimeter of the openings 24, but may be defined on or about any portion of the openings 24.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. An apparatus for removing wrinkles in fabric articles, the apparatus comprising:

a casing defining a volume therein and having a reservoir containing a liquid for providing treatment to the fabric article;

one or more transducers for converting the liquid to a treatment mist;

a platen carried by the casing and defining a plurality of openings for allowing flowthrough of treatment mist;

a pathway defined between the reservoir and the platen for allowing a travel path for the treatment mist;

a fluid pump in communication with the pathway to aid flow of treatment mist through the pathway; and a heating element in communication with the platen configured for heating the platen, wherein the platen defines a plurality of grooves in which at least one opening of the plurality of openings is defined, and further wherein at least one of the grooves defines a greater cross-section at a medial position thereof than at and end position thereof to cooperatively form a mist trap when the apparatus is pressed against the fabric article, the mist trap configured for treating the fabric article.

2. The apparatus of claim 1, wherein the end position of the at least one of the grooves defines a restriction barrier that reduces the cross-section thereof.

3. The apparatus of claim 1, wherein the at least one of the grooves defines a depth at a medial position thereof that is greater than the depth at an end position thereof.

4. The apparatus according to claim 1, wherein the transducer is configured for being received in the reservoir when the reservoir is received in the casing.

5. The apparatus of claim 1, further including liquid level sensors configured for extending into the reservoir to determine a liquid level therein.

6. The apparatus of claim 5, wherein the liquid level sensors are in communication with a computer module, the module being in communication with the transducer and configured for controlling operation thereof based on the liquid level in the reservoir.

7. The apparatus of claim 1, further including a condensation collector positioned within the pathway, the collector defining a housing that contains an absorbent material and a plurality of vents that allow for drying the absorbent material.

8. A wrinkle removing apparatus for fabric articles, comprising:

a casing defining a volume therein;

a reservoir configured for being selectively received in the casing and containing a liquid for providing treatment to the fabric article;

a platen carried by the casing and defining a plurality of openings for allowing flowthrough of liquid;

a heating element; and liquid level sensors configured for extending into the reservoir to determine a liquid level therein.

9. The apparatus according to claim 8, further comprising a transducer configured for being received in the reservoir when the reservoir is received in the casing, the transducer being further configured for atomizing the liquid into a vapor.

10. The apparatus according to claim 9, wherein the transducer is a vibratory transducer configured to convert liquid in the reservoir into the vapor.

11. The apparatus of claim 10, further including a valve in a pathway defined by the casing between the reservoir and the openings of the platen, and further including a button on the casing in communication with the valve for selectively moving the valve between a closed position and an open position.

12. The apparatus of claim 11, wherein the valve is biased into a closed position.

13. The apparatus of claim 8, further including a vapor guide defined in a pathway that is defined by the casing between the reservoir and the openings of the platen, the vapor guide defining an opening for allowing flowthrough of mist.

14. The apparatus of claim 8, further including a perturbator positioned proximal the platen.

15. The apparatus of claim 8, wherein the platen defines a plurality of grooves, a portion of which define the plurality of openings.

16. The apparatus of claim 15, wherein the grooves define generally a cross-section such that the depth of the grooves at a medial position thereof is greater than the depth at an end position thereof such that the liquid tends to be maintained in a medial portion of the grooves.

17. The apparatus of claim 8, wherein the openings of the platen define a plurality of capillary grooves for drawing away collected liquid.

18. The apparatus of claim 8, wherein the heating element is positioned proximal the platen.

19. The apparatus of claim 8, wherein the heating element is positioned within the platen.

20. The apparatus of claim 8, wherein the liquid level sensors are in communication with a computer module, the module being in communication with a transducer received within the reservoir when the reservoir is received in the casing, the control module configured for controlling operation of the transducer depending on the liquid level of the reservoir.

21. The apparatus of claim 8, further including a condensation collector positioned within a pathway defined by the casing between the reservoir and the openings of the platen, the collector defining a housing that contains an absorbent material and a plurality of vents that allow for drying the absorbent material.

22. A wrinkle removing apparatus for fabric articles, comprising:

a casing defining a volume therein;

a reservoir configured for being selectively received in the casing and containing a liquid for providing treatment to the fabric article;

a platen carried by the casing and defining a plurality of openings for allowing flowthrough of liquid; and a perturbator positioned proximal the platen.

23. A wrinkle removing apparatus for fabric articles, comprising:

a casing defining a volume therein;

a reservoir configured for being selectively received in the casing and containing a liquid for providing treatment to the fabric article; and a platen carried by the casing and defining a plurality of openings for allowing flowthrough of liquid, wherein the openings define a plurality of capillary grooves for drawing away collected liquid.

24. A wrinkle removing apparatus for fabric articles, comprising:

a casing defining a volume therein;

a reservoir configured for being selectively received in the casing and containing a liquid for providing treatment to the fabric article;

a platen carried by the casing and defining a plurality of openings for allowing flowthrough of liquid;

a pathway defined by the casing between the reservoir and the openings of the platen; and a condensation collector positioned within the pathway, the collector defining a housing that contains an absorbent material and a plurality of vents that allow for drying the absorbent material.

25. A wrinkle removing apparatus for fabric articles, comprising:

a casing defining a volume therein;

a reservoir configured for being selectively received in the casing and containing a liquid for providing treatment to the fabric article;

a platen carried by the casing and defining a plurality of openings for allowing flowthrough of liquid;

a pathway defined by the casing between the reservoir and the openings of the platen;

one of a fan and a blower in communication with the pathway for creating a pressure differential to aid flow of liquid from the reservoir to the openings of the platen; and a valve in the pathway for restricting flowthrough of liquid.

* * * * *